US010940349B2

(12) United States Patent
Schnell et al.

(10) Patent No.: US 10,940,349 B2
(45) Date of Patent: Mar. 9, 2021

(54) PROTECTIVE CAP FOR A SPRINKLER NOZZLE, USE OF SUCH A PROTECTIVE CAP, AND METHOD FOR ASSEMBLING AND/OR DISASSEMBLING A SPRINKLER NOZZLE ON A PIPELINE

(71) Applicant: MINIMAX GMBH & CO. KG, Bad Oldesloe (DE)

(72) Inventors: Stefan Schnell, Stockelsdorf (DE); Frank Rönnfeldt, Sühlen (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 16/097,896

(22) PCT Filed: May 2, 2016

(86) PCT No.: PCT/EP2016/059763
§ 371 (c)(1),
(2) Date: Oct. 31, 2018

(87) PCT Pub. No.: WO2017/190761
PCT Pub. Date: Nov. 9, 2017

(65) Prior Publication Data

US 2019/0143163 A1 May 16, 2019

(51) Int. Cl.
*A62C 35/68* (2006.01)
*A62C 31/28* (2006.01)
(Continued)

(52) U.S. Cl.
CPC ..... *A62C 35/68* (2013.01); *A62C 31/28* (2013.01); *A62C 37/11* (2013.01); *A62C 31/02* (2013.01);
(Continued)

(58) Field of Classification Search
CPC ..... A62C 35/68; A62C 37/08; A62C 37/12; A62C 37/11; A62C 31/28; A62C 31/02; B05B 15/16; B05B 1/265
(Continued)

(56) References Cited

U.S. PATENT DOCUMENTS 1,469,336 A * 10/1923 Rowley ..... A62C 37/08 169/51
2,511,945 A * 6/1950 Rowley ..... A62C 37/12 239/472
(Continued)

FOREIGN PATENT DOCUMENTS

CN 2780255 Y 5/2006
CN 2853105 Y 1/2007
(Continued)

OTHER PUBLICATIONS

International Searching Authority, International Search Report in German & English translation in International Appln. No. PCT/EP2016/059763, 5 pages.
(Continued)

*Primary Examiner* — Joseph A Greenlund
(74) *Attorney, Agent, or Firm* — Perkins Coie LLP

(57) ABSTRACT

The present invention relates to a protective cap for an extinguishing nozzle, in particular a sprinkler nozzle, which has at least a nozzle main body with a nozzle outlet, with a cap main body, and a cap neck which is arranged on the cap main body, the cap main body having a force transmission section for bearing in sections against a nozzle main body of the extinguishing nozzle in a force-transmitting, preferably positively locking manner, and the protective cap, in particular the cap neck, being set up to mechanically shield the
(Continued)

nozzle outlet of the extinguishing nozzle, the cap main body having an outer contour with one or more action surfaces for attaching a tool.

22 Claims, 4 Drawing Sheets

(51) Int. Cl.

| | |
|---|---|
| ***A62C 37/11*** | (2006.01) |
| ***A62C 31/02*** | (2006.01) |
| *B05B 15/16* | (2018.01) |
| *A62C 37/12* | (2006.01) |
| *A62C 37/08* | (2006.01) |
| *B05B 1/26* | (2006.01) |

(52) U.S. Cl.
CPC ..... *A62C 37/08* (2013.01); *A62C 37/12* (2013.01); *B05B 1/265* (2013.01); *B05B 15/16* (2018.02)

(58) Field of Classification Search
USPC ..... 169/51, 37
See application file for complete search history.

(56) References Cited

U.S. PATENT DOCUMENTS

| | | | | |
|---|---|---|---|---|
| 3,388,747 | A | 6/1968 | Hodnett | |
| 3,801,014 | A | 4/1974 | Cantales | |
| 4,066,129 | A | 1/1978 | Anderson | |
| 4,176,756 | A | 12/1979 | Gellman | |
| 5,097,906 | A | 3/1992 | Polan | |
| 5,447,338 | A | 9/1995 | Kikuchi | |
| 6,112,821 | A | 9/2000 | Yokoi | |
| 6,123,153 | A | 9/2000 | Finnegan | |
| 6,206,033 | B1 | 3/2001 | Chang | |
| 6,347,669 | B1 | 2/2002 | Sundholm | |
| 6,487,942 | B1 | 12/2002 | Carter et al. | |
| 6,669,111 | B2 | 12/2003 | Vinson et al. | |
| 7,185,567 | B2 | 3/2007 | Ide | |
| 7,540,330 | B2 | 6/2009 | Orr et al. | |
| D611,570 | S | 3/2010 | Yang | |
| 7,757,961 | B2 | 7/2010 | Yang | |
| 7,757,967 | B1 | 7/2010 | Yang | |
| 8,662,190 | B2 | 3/2014 | Watson | |
| D706,619 | S | 6/2014 | Oldham | |
| 8,936,206 | B1 | 1/2015 | Wright | |
| 9,027,660 | B2 | 5/2015 | Oldham | |
| 9,320,929 | B2 | 4/2016 | Koiwa | |
| D768,816 | S | 10/2016 | Pogliari et al. | |
| 9,630,039 | B2 | 4/2017 | Koiwa | |
| D799,924 | S | 10/2017 | Koiwa | |
| 2003/0173094 | A1* | 9/2003 | Vinson | A62C 31/28 169/37 |
| 2004/0134670 | A1* | 7/2004 | Orr | A62C 31/28 169/37 |
| 2005/0035022 | A1* | 2/2005 | Ide | B65D 61/00 206/528 |
| 2005/0247169 | A1* | 11/2005 | Faries, Jr. | B25B 13/485 81/176.15 |
| 2006/0201286 | A1* | 9/2006 | Ide | B25B 13/06 81/176.15 |
| 2006/0219819 | A1* | 10/2006 | Franson | B05B 1/267 239/502 |
| 2006/0249603 | A1* | 11/2006 | Fletcher | A62C 35/68 239/600 |
| 2007/0256844 | A1* | 11/2007 | Blasing | A62C 35/68 169/51 |
| 2008/0060823 | A1* | 3/2008 | Ma | A62C 35/68 169/37 |
| 2009/0266203 | A1* | 10/2009 | Orr | B25B 9/00 81/64 |
| 2010/0059235 | A1* | 3/2010 | Feenstra | A62C 37/12 169/42 |
| 2010/0132962 | A1* | 6/2010 | Silva, Jr. | A62C 37/12 169/37 |
| 2012/0255629 | A1* | 10/2012 | Goss | A62C 35/68 137/377 |
| 2014/0096982 | A1* | 4/2014 | Oldham | B05B 15/16 169/37 |
| 2014/0262356 | A1* | 9/2014 | Ringer | A62C 37/11 169/37 |
| 2015/0075334 | A1* | 3/2015 | Watson | B25B 13/481 81/186 |
| 2015/0297927 | A1* | 10/2015 | Pipe | A62C 37/14 169/37 |
| 2016/0023029 | A1* | 1/2016 | Almeida | A62C 35/68 169/37 |
| 2016/0030785 | A1* | 2/2016 | Ringer | A62C 35/64 169/41 |
| 2016/0030787 | A1* | 2/2016 | De Vries | A62C 37/12 169/46 |
| 2016/0221018 | A1* | 8/2016 | Oh | A62C 35/68 |
| 2017/0028236 | A1* | 2/2017 | Macomber | A62C 37/12 |
| 2017/0326393 | A1* | 11/2017 | Oldham | A62C 35/68 |
| 2019/0143163 | A1* | 5/2019 | Schnell | A62C 37/11 169/37 |

FOREIGN PATENT DOCUMENTS

| | | | |
|---|---|---|---|
| CN | 104511114 | A | 4/2015 |
| KR | 2010 0002350 | A | 1/2010 |
| KR | 2010 0030149 | A | 3/2010 |
| WO | WO 2017/190761 | A1 | 11/2017 |
| WO | WO 2017/196596 | A1 | 11/2017 |

OTHER PUBLICATIONS

Office Action with English translation, Chinese Application No. 201680086987.0, 21 pages (dated Apr. 2, 2020).
Office Action with English translation, Korean Application No. 10-2018-7034816, 29 pages (dated Feb. 28, 2020).

* cited by examiner

PROTECTIVE CAP FOR A SPRINKLER NOZZLE, USE OF SUCH A PROTECTIVE CAP, AND METHOD FOR ASSEMBLING AND/OR DISASSEMBLING A SPRINKLER NOZZLE ON A PIPELINE

PRIORITY CLAIM AND INCORPORATION BY REFERENCE

This application is a 35 U.S.C. § 371 application of International Application No. PCT/EP2016/059763, filed May 2, 2016, which is incorporated by reference in its entirety.

TECHNICAL FIELD

The present invention relates to a protective cap for an extinguishing nozzle, in particular a sprinkler nozzle, which has a nozzle main body with a nozzle outlet and a spray head which is arranged on the nozzle main body. Furthermore, the invention relates to the use of a protective cap of this type and to a method for mounting and/or dismantling an extinguishing nozzle, in particular a sprinkler nozzle, on a pipeline of a nozzle pipe system of a fire extinguishing system.

BACKGROUND AND SUMMARY OF THE INVENTION

Protective caps for extinguishing nozzles are used, inter alia, during the transport of the extinguishing nozzles, the mounting of the extinguishing nozzles on a pipeline, and in the case of temporary dismantling of the extinguishing nozzles. By way of protective caps of this type, a direct contact with, for example, a nozzle outlet on the nozzle main body and a spray head is to be avoided. In other refinements of the extinguishing nozzle, the contact is to be avoided with the spray head and a spraying disk which is arranged thereon, and a triggering element which is preferably configured as a thermal triggering element with a glass body. In particular, possible damage and a potential defect of the extinguishing nozzle are to be counteracted.

Protective caps are known from the prior art which have a cylindrical or frustum conical cap body with an open end and a closed end, the cap body being pushed with the open end thereof over the spray head in the direction of the longitudinal axis of the sprinkler. U.S. Pat. No. 7,540,330B2 discloses a protective cap of this type. In order to fix the protective cap on the extinguishing nozzle, the cap body has one or more material projections on its inner side in the region of the closed end. The protective cap is pushed with the material projections over the spraying disk of the extinguishing nozzle to such an extent that said material projections engage around the spraying disk. During plugging on and during removal of the protective cap, flexural loads act in each case on the spraying disk in the case of every exertion of force in other directions than the pushing-on direction, as a result of which an undesired deformation of the spraying disk can occur which has a disadvantageous effect on the spray pattern which is to be generated by way of the spraying disk.

Furthermore, the cylindrical or conical section of the cap body of the protective cap which is known from U.S. Pat. No. 7,540,330 B2 extends over the spray head and a spray head holder which connects the spray head to the nozzle main body. During mounting or dismantling of the extinguishing nozzle, the mounting tool is brought directly into contact with the tool attachment on the nozzle main body. This has the disadvantage on painted extinguishing nozzles, however, that the mounting and also subsequent dismantling cannot be performed without visible signs of wear.

The invention was based on the object of specifying a protective cap for an extinguishing nozzle and a method for mounting and/or dismantling an extinguishing nozzle, by way of which the extinguishing nozzle can be mounted and/or dismantled reliably and at the same time damage on the extinguishing nozzle and, in particular, on its surface coatings is avoided.

The invention achieves the object on which it is based in the case of a protective cap for an extinguishing nozzle, in particular for a sprinkler nozzle, of the type denoted at the outset by way of a cap main body, and a cap neck which is arranged on the cap main body, the cap main body having a force transmission section for bearing against a nozzle main body of the extinguishing nozzle in a force-transmitting, preferably positively locking manner, and the protective cap, in particular the cap neck, being set up to mechanically shield a nozzle outlet of the extinguishing nozzle, the cap main body having an outer contour with one or more action surfaces for attaching a tool. The protective cap is preferably provided for an extinguishing nozzle with a spray head, the protective cap, in particular the cap neck, then being dimensioned in such a way that, in the mounted state on the extinguishing nozzle, it encloses the spray head partially or completely.

Further preferably, the extinguishing nozzle has a spraying disk which is arranged on the spray head, the protective cap, in particular the cap neck, being dimensioned with respect to the spraying disk in such a way that, in the mounted state, it is arranged spaced apart from the spraying disk.

The invention is based on the finding that mounting and dismantling of the extinguishing nozzle is possible by way of the provision of a cap main body which can be coupled via its force transmission section to a tool attachment which is provided on the nozzle main body and, in addition, has an outer contour with at least one, preferably a plurality of action surfaces for a torque-transmitting tool, without the extinguishing nozzle itself coming directly into contact with the tool. Any signs of wear during the mounting and/or dismantling on the tool attachment of the extinguishing nozzle can thus be avoided. A direct action of force on the spraying disk is therefore avoided during the mounting and/or dismantling of the extinguishing nozzle on/from the pipeline or the attachment or removal of the protective cap.

Regions of the cap neck can bear directly against the spray head or the spray head holder, without, however, in the process coming into contact with the spraying disk of the spray head.

Further preferably, the protective cap for an extinguishing nozzle is provided with a triggering element, by the protective cap, in particular the cap neck, being dimensioned and set up to shield the triggering element mechanically in the mounted state. A sufficiently large protective space is preferably defined by means of a spacing of the cap neck from the spraying disk or from the triggering element of the extinguishing nozzle, which protective space prevents an unwanted contact with the triggering element which is preferably a thermal triggering element.

Further preferably, the extinguishing nozzle has a closure element which is arranged on the nozzle outlet, and the protective cap, in particular the cap neck and/or the cap main body, is set up to shield the closure element mechanically in the mounted state.

In one preferred development of the invention, the cap main body and the cap neck in each case have a lateral introduction and discharge slot which extends substantially parallel to the longitudinal axis of the protective cap. The introduction and discharge slot is preferably arranged on the cap main body and the cap neck in such a way that the protective cap can be brought into contact and/or out of contact with the extinguishing nozzle in the radial direction, in relation to the longitudinal axis of the extinguishing nozzle. Damage-free bringing of the protective cap into contact or out of contact on the extinguishing nozzle is made possible by way of the lateral introduction and discharge slot.

The introduction and discharge slot extends over the entire height of the protective cap, the slot width of the introduction and discharge slot changing over the height of the protective cap. The introduction and discharge slot preferably has a slot width which is adapted to the outer shape of the nozzle main body in the region of the cap main body and/or a slot width which is adapted to the shape of the spray head and a spray head holder in the region of the cap neck. As a result, a lateral movement, preferably directed perpendicularly with respect to the longitudinal axis of the extinguishing nozzle, of the extinguishing nozzle during the bringing into contact and out of contact is possible with a small effort.

It is provided in one preferred refinement of the protective cap according to the invention that the outer contour of the cap main body has a polygonal tool attachment which is configured with a predefined flats width. Therefore, a multiplicity of action surfaces for the tool are preferably configured on the outer contour of the cap main body, it being possible for the tool to be attached on the outer contour of the cap main body of the protective cap according to the invention in different orientations. Via this, the mounting and/or dismantling of the extinguishing nozzle are/is simplified. The cap main body preferably has a substantially hexagonal outer contour in the region of its tool attachment, which outer contour has a predefined flats width. The tool attachment on the outer contour is preferably arranged at the same level as the force transmission section on the inner contour of the cap main body. The cap main body preferably has a substantially hexagonal inner contour as a force transmission section.

In a further preferred refinement, on its inner contour which faces the nozzle main body, the cap main body has a guide means which is set up to guide the protective cap in the radial direction with respect to the longitudinal axis of the extinguishing nozzle along a guide part of corresponding configuration on the nozzle main body while being brought into contact or out of contact. During the movement for bringing the protective cap into contact or out of contact with the extinguishing nozzle, a movement in the axial direction of the extinguishing nozzle, that is to say parallel to the longitudinal axis of the extinguishing nozzle, is counteracted by the guide means. In one alternative refinement of the protective cap according to the invention, a guide means of this type is provided on the cap neck or in the connecting region between the cap main body and the cap neck.

The guide means is preferably configured as a projection, in particular as a web, which protrudes on the inner contour of the cap main body. The cap main body preferably engages by way of the projection into a recess, in particular a groove-like undercut on the nozzle main body. Via this, an enforced strictly radial movement, in relation to the longitudinal axis of the extinguishing nozzle, is possible while the protective cap is being brought into contact and out of contact with the extinguishing nozzle. Furthermore, in the mounted state of the protective cap on the extinguishing nozzle, a locking action is preferably ensured in the longitudinal direction via the projection on the inner contour of the cap main body. The projection therefore at the same time serves as a locking means.

Furthermore, at its spray head-side end, the cap neck preferably has a terminating face with a recess for at least one section of the spray head. That end of the cap neck which faces the spray head is terminated toward the spraying disk by means of the terminating face. An undesired contact with the nozzle outlet on the nozzle main body or a closure element for the nozzle outlet or a triggering element of the extinguishing nozzle can be avoided in this way, depending on the type of extinguishing nozzle which is used. The recess in the terminating face is preferably a groove-like or slot-like wall aperture. In one preferred embodiment of the present invention, the center axis of the recess in the terminating face of the cap neck and the center axis of the introduction and discharge slot in the cap neck and the cap main body lie in one plane.

The recess in the terminating face preferably has a shape which is adapted to the shape of the spray head and is set up to fix the end which faces the spray head on the spray head. The side faces which delimit the recess preferably bear in sections or completely preferably against the spray head and against regions of the spray head holder.

In one preferred embodiment of the protective cap according to the invention, at least one wall region of the cap main body and the cap neck, which wall region is arranged so as to lie opposite the introduction and discharge slot, is elastically deformable. The protective cap according to the invention preferably has two protective cap limbs which can be moved relative to one another and are connected to one another via the elastically deformable wall region. The elastically deformable wall region preferably has a spring function which brings it about that the protective cap limbs can move apart from one another counter to a restoring force during the attachment or removal of the protective cap on/from the extinguishing nozzle, and move back automatically into their starting position with respect to one another as a consequence of the restoring force after bringing into contact or out of contact with the extinguishing nozzle. The introduction and discharge slot on the cap main body and the cap neck preferably has a smaller slot width than the dimensions of at least the cap main body and the spray head. As a result, an automatic clamping or locking action of the protective cap according to the invention on the extinguishing nozzle is achieved. In one embodiment of the invention, the elastic deformability of the protective cap limbs on both sides of the introduction plane is brought about by way of a separate elastic spring element which connects the protective cap limbs to one another.

In a further embodiment of the invention, the cap main body and the cap neck are configured in one piece and preferably as an injection molded part. A high strength of the cap main body, the cap neck and the elastically deformable wall region is achieved by way of the single-piece configuration of the protective cap according to the invention. This ensures a secure connection between the protective cap limbs. A material, such as plastic, which has elastic properties and can preferably be processed by means of the injection molding method is preferably used for the configuration of the protective cap. In addition, the use of a plastic provides the advantage of making the elastically deformable wall region (also called a connecting region in the following text) between the protective cap limbs elastically deformable in a simple way. Thermoplastic materials, such as PE, PA or PP, are preferably used. In another embodiment of the invention, a metallic material with resilient properties is used for configuring the connecting region between the protective cap limbs.

In one preferred embodiment, one or more handles which can be actuated by hand in order to bring the cap main body into contact or out of contact with the nozzle main body is/are provided on the protective cap according to the invention. By means of the handles which configure a section which can be gripped by hand on the protective cap, the protective cap according to the invention can be brought into contact or out of contact with the extinguishing nozzle perpendicularly with respect to the longitudinal axis of the extinguishing nozzle in a simplified manner, preferably by way of only one hand. Bringing the protective cap into contact with the extinguishing nozzle is particularly preferably realized by way of the protective cap being pushed laterally onto the extinguishing nozzle. Bringing the protective cap out of contact with the extinguishing nozzle is then to be understood to mean opposed lateral pulling off of the protective cap from the extinguishing nozzle.

In one embodiment of the invention, the protective cap has a first handle which is arranged on the cap neck and is preferably configured as a bracket. The bracket brings it about that a person who is removing or plugging on the protective cap does not have to make contact with the protective cap on the cap main body or on the cap neck in order to move said protective cap. Via this, the risk of damage on the extinguishing nozzle is reduced further. The bracket with its handle section preferably extends radially with respect to the longitudinal axis of the protective cap, the center axis of the bracket lying in one plane with the introduction and discharge slot.

In a further embodiment of the invention, in addition or as an alternative to the first handle, two second handles are provided which are configured as two actuating flanks which extend on both sides along the lateral introduction and discharge slot. In a basic state, the actuating flanks are preferably oriented with respect to one another at an angular range $\alpha$ of from 60° to 120° . Via the actuating flanks, a force is applied to the protective cap according to the invention while bringing it into contact by way of sliding of the actuating flanks on the protective cap, which force assists the widening of the introduction and discharge slot. Via this, bringing the protective cap out of contact with the extinguishing nozzle is simplified further. In the basic state, the two actuating flanks preferably run at an angle $\alpha$ of from approximately 80° to 100°, preferably 90°, with respect to one another. Other angular ranges than the ones specified are also possible. One embodiment of the invention provides that the first handle and the second handles are arranged jointly on the protective cap. In a further embodiment, in each case only the first handle or the two second handles are arranged on the protective cap.

A further refinement according to the invention of the protective cap according to the invention provides that a cap shield for enclosing the spraying disk of the extinguishing nozzle in sections is additionally arranged on the cap neck. The spraying disk of the extinguishing nozzle is enclosed by way of the cap shield which can be open or closed, as a result of which the risks of possible damage of the extinguishing nozzle, in particular the spraying disk, by way of an extreme action during mounting, dismantling or during transport are reduced further. The cap shield is preferably arranged at the spray head-side end of the cap neck. In one embodiment, the cap shield is of open configuration at its end which faces away from the cap neck. In an alternative embodiment, the cap shield is configured as a type of capsule with a receiving space for the spraying disk, which receiving space is closed by more than 50%, preferably by more than 75% and therefore virtually completely. In a further embodiment, the cap shield is of closed configuration.

The cap shield preferably has a lateral introduction and discharge slot for the spraying disk of the extinguishing nozzle, which lateral introduction and discharge slot is adapted to the outer contour of the spraying disk which can be guided through the slot. This ensures that the spraying disk does not come into contact with the cap shield during bringing of the protective cap into contact or out of contact with the extinguishing nozzle. The lateral introduction and discharge slot preferably has a slot width at the level of the spraying disk, which slot width is greater than the diameter of the spraying disk.

A further aspect of the invention relates to a kit, comprising an extinguishing nozzle, in particular a sprinkler nozzle, with a nozzle main body with a nozzle outlet, preferably a spray head which is arranged on the nozzle main body, and a protective cap in accordance with one of the above-described preferred embodiments which is mounted on the extinguishing nozzle. During mounting of a kit according to the invention comprising the extinguishing nozzle and a protective cap, the mounting tool is attached on the outer contour of the cap main body instead of by way of the nozzle main body which usually has a tool attachment. The force which acts on the cap main body is transmitted via a transmission section on the cap main body to the nozzle main body. With regard to further preferred embodiments of the kit and advantages which result therefrom, reference is made to the above comments with respect to the protective cap according to the invention.

In accordance with a further aspect, the invention relates to a method for mounting an extinguishing nozzle, in particular a sprinkler nozzle, on a pipeline of a nozzle pipe system of a fire extinguishing system. As described above, the method according to the invention addresses the object of specifying an improved possibility of mounting an extinguishing nozzle on a pipeline with a considerably reduced risk of damage.

The method according to the invention achieves said object by way of the steps: bringing a protective cap into contact with at least one nozzle main body of an extinguishing nozzle, or providing an extinguishing nozzle which is equipped with a protective cap; fastening the extinguishing nozzle which is equipped with the protective cap to an outlet opening of a pipeline of a nozzle pipe network using a tool, the tool being attached to an outer contour of the protective cap by way of one or more action surfaces, and optionally bringing the protective cap out of contact with an extinguishing nozzle which is mounted on a pipeline, preferably in the radial direction with respect to the longitudinal axis of the mounted extinguishing nozzle. In order to bring the protective cap into contact, it is preferably pushed laterally onto the extinguishing nozzle, a transmission section on the inner contour of the protective cap, in particular on the cap main body, being brought to bear against the nozzle main body. Here, a positively locking coupling preferably takes place between the cap main body and the nozzle main body. The fastening of the extinguishing nozzle to an outlet opening of a pipeline preferably takes place by means of the extinguishing nozzle which has an external threaded section being screwed into an internal threaded section of the outlet opening. After the mounting of the extinguishing nozzle on the pipeline, the protective cap is brought out of contact with the extinguishing nozzle immediately or at a later time, preferably by the protective cap being pulled off in the radial direction with respect to the longitudinal axis of the extinguishing nozzle. Here, bringing it out of contact can take place by way of only one hand.

In addition, in accordance with a further aspect, the invention relates to a method for dismantling an extinguishing nozzle, in particular a sprinkler nozzle, from a pipeline of a nozzle pipe system of a fire extinguishing system, by way of which it likewise addresses the above-specified object, namely of dismantling an extinguishing nozzle at least temporarily without the risk of damaging the extinguishing nozzle which is intended for reuse.

The method according to the invention for dismantling an extinguishing nozzle from a pipeline achieves said object by way of the steps: bringing a protective cap into contact with at least one nozzle main body of an extinguishing nozzle; releasing the extinguishing nozzle which is equipped with the protective cap at an outlet opening of a pipeline of a nozzle pipe network using a tool, the tool for releasing the extinguishing nozzle being attached on an outer contour of the protective cap by way of one or more action surfaces, and removing the extinguishing nozzle from the pipeline and preferably leaving the protective cap on the dismantled extinguishing nozzle. Bringing the protective cap into contact with the extinguishing nozzle or bringing the cap main body into contact with the nozzle main body preferably takes place by way of the protective cap being pushed on by hand via its introduction and discharge slot. In the present case, the release of the extinguishing nozzle takes place by way of the extinguishing nozzle being screwed out at an outlet opening of the pipeline. For screwing out, in a similar manner to mounting, a force is generated on the protective cap by means of a tool, as a result of which a direct action of force of the tool on the extinguishing nozzle, in particular on the surface of the extinguishing nozzle, is avoided. The extinguishing nozzle is subsequently removed from the pipeline and, in the case of a planned remounting of the removed extinguishing nozzle on the pipeline, the protective cap is left on the dismantled extinguishing nozzle.

With regard to preferred further refinements of the method for mounting and the method for dismantling an extinguishing nozzle on a pipeline and advantages which result therefrom, reference is made to the above comments with respect to the protective cap according to the invention.

Furthermore, the invention relates to a method for mounting/dismantling sprinkler nozzles, with a high quality surface coating: a coating which is applied in gaseous form; for example CVD or PVD; a coating which is applied in liquid form; for example painting; a coating which is applied in dissolved form, for example galvanizing, chromating, chemical nickel; or a coating which is applied as a solid; for example powder coating.

Furthermore, the invention also relates to the use of a protective cap in accordance with one of the above-described preferred embodiments for mounting and/or dismantling an extinguishing nozzle on/from a pipeline of a nozzle pipe system of a fire extinguishing system in a protected manner. Reference is made to the full scope of the above comments with regard to the advantages according to the invention of a use of this type.

BRIEF DESCRIPTION OF THE DRAWINGS

Furthermore, the invention will be described in greater detail in the following text using possible exemplary embodiments with reference to the appended figures, in which.

MODE(S) FOR CARRYING OUT THE INVENTION

Figure 1:
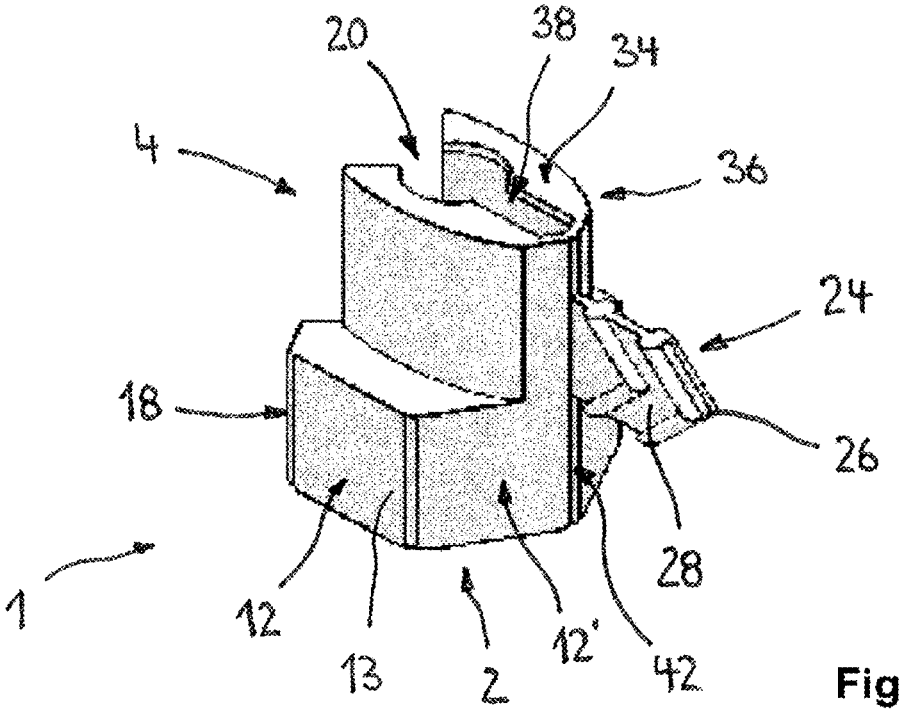
FIG. 1 shows a perspective view of a first embodiment of a protective cap according to the invention.

FIG. 1 shows a perspective view of a protective cap 1 which has a cap main body 2 and a cap neck 4 which is fastened to the cap main body 2. The cap main body 2 has a force transmission section 6 (FIG. 2) for bearing against or attaching to a nozzle main body 8 (FIG. 5) of a sprinkler nozzle 10 in a force-transmitting manner. Furthermore, the cap main body 2 has an outer contour with a plurality of action surfaces 12, 12' for attaching a tool. In the embodiment which is shown, the action surfaces 12, 12' on the outer contour 13 are arranged at the same level as the force transmission section 6 on the inner contour of the cap main body 2.

Figure 5:
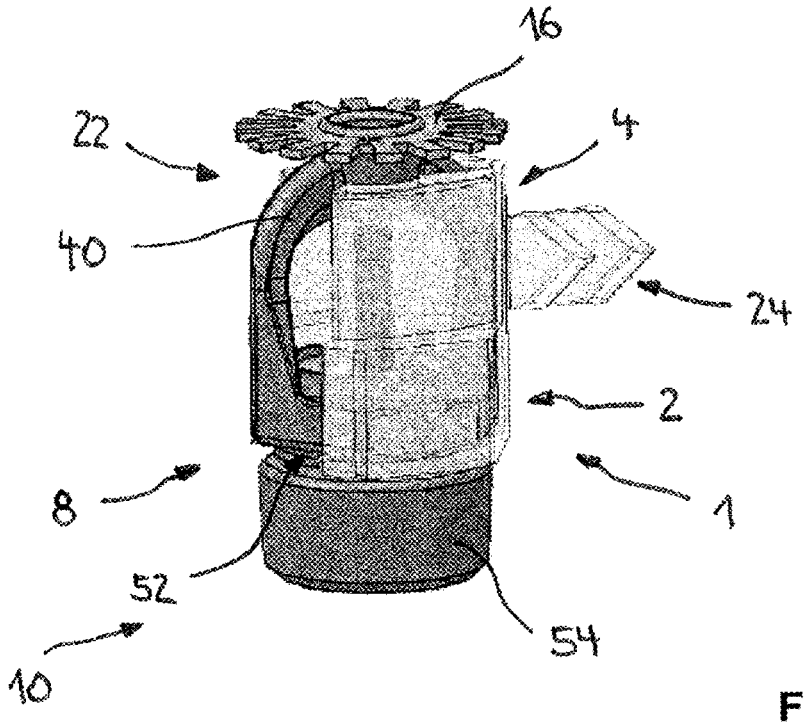
FIG. 5 shows a perspective illustration of a kit according to the invention comprising a sprinkler nozzle and a protective cap.
Figure 6:
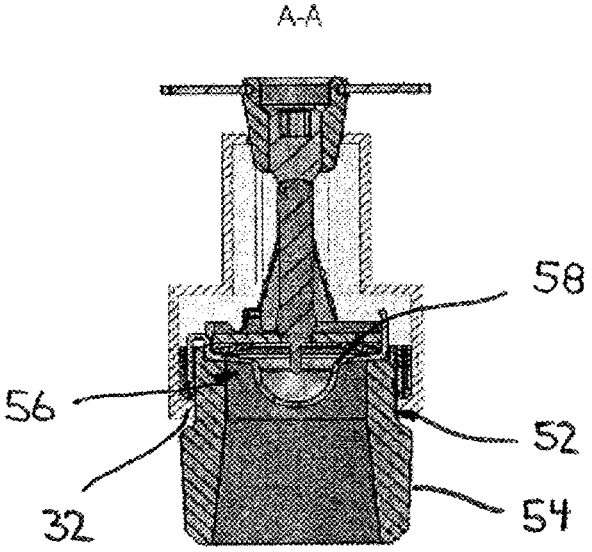
FIG. 6 shows a view of a sprinkler nozzle and a mounted protective cap in section.

The cap neck 4 is set up for mechanically shielding a triggering element 14 which is shown in FIG. 6, as a result of which a direct contact of the triggering element 14, for example, by way of a tool is avoided. In the mounted state on the sprinkler nozzle 10, the cap neck 4 is arranged spaced apart from a spraying disk 16 (FIG. 5) of the sprinkler nozzle 10. There is no direct contact between the spraying disk 16 and the cap neck 4. As can be seen from FIG. 1, furthermore, the outer contour 13 of the cap main body 2 has a preferably hexagonal tool attachment 18 with a predefined flats width. The mounting or dismantling of the sprinkler nozzle 10 is therefore possible via the tool attachment 18 by way of a commercially available wrench.

The protective cap 1 has a lateral introduction and discharge slot 20 which extends in the direction of the longitudinal axis "L" of the protective cap and via which the protective cap 1 can be pushed and also can be removed again over at least the nozzle main body 8 and sections of a spray head 22 on the sprinkler nozzle 10. As can be gathered from FIGS. 1 and 2, furthermore, the protective cap 1 has a first handle 24 which is arranged on the cap neck 4 and by way of which the protective cap 1 can be brought into contact or out of contact with the sprinkler nozzle 10 laterally, that is to say with a movement direction radially with respect to the longitudinal axis of the sprinkler nozzle. On that embodiment of the protective cap 1 according to the invention which is depicted in FIGS. 1 and 2, the first handle 24 is configured as a bracket 26 with a handle part 28.

Figure 2:
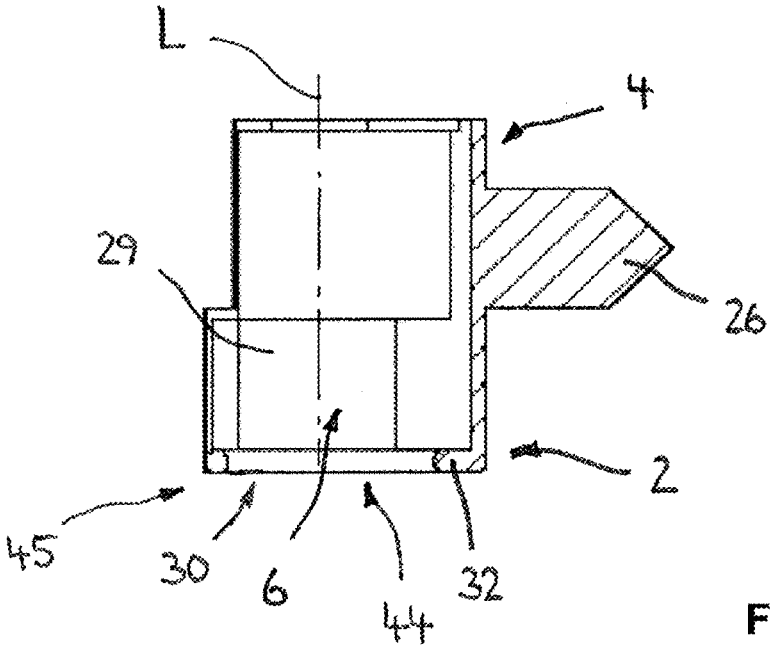
FIG. 2 shows a view of the protective cap according to the invention in accordance with FIG. 1 in section.

As FIG. 2 illustrates, a guide means 30 is arranged on the inner contour 29 of the cap main body 2, via which guide means 30 the protective cap 1 can be pushed onto the sprinkler nozzle 10 or can be removed from the latter in a predefined position along the longitudinal axis of the sprinkler nozzle. In this way, a movement in the axial direction is counteracted. In the embodiment which is shown in FIG. 2, the guide means 30 is a projection 32 which protrudes on the inner contour of the cap main body 2 and is optionally configured as a web.

Figure 3:
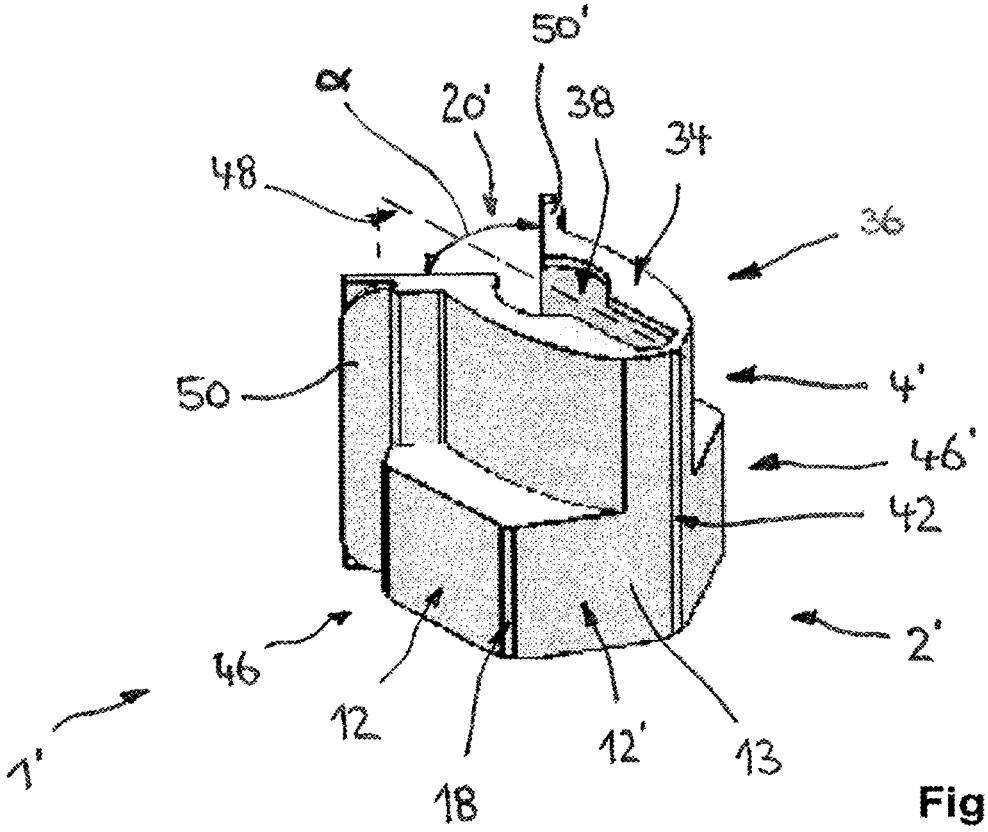
FIG. 3 shows a perspective illustration of a second exemplary embodiment of a protective cap according to the invention.
Figure 4:
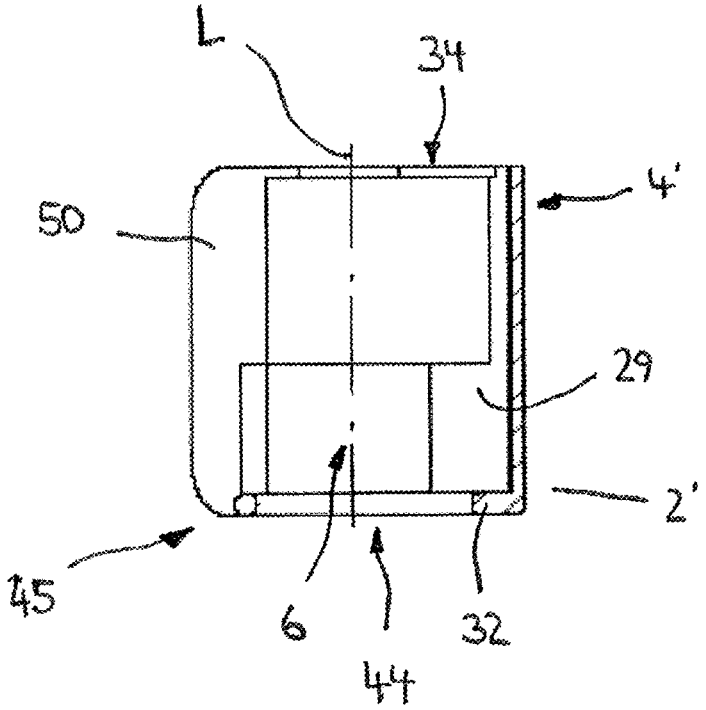
FIG. 4 shows a sectional illustration of the protective cap according to the invention in accordance with FIG. 3.

FIGS. 3 and 4 show a further possible embodiment of a protective cap 1' which comprises a cap main body 2' and a cap neck 4'. In a similar manner to the protective cap 1, the cap main body 2 is also brought into contact with a section of a nozzle main body 8 of the sprinkler nozzle 10 by way of a force transmission section 6 in the form of a substantially hexagonal inner contour. FIG. 3 illustrates, furthermore, that, like the cap neck 4 which is shown in FIGS. 1 and 2, the cap neck 4' has a terminating face 34 at an end 36 of the cap neck 4', which end 36 faces the spray head 22 of the sprinkler nozzle 10, which terminating face 34 ends at a spacing from the spraying disk 16 of the sprinkler nozzle 10. In addition, the terminating face 34 has a recess 38 which penetrates the wall at the end 36 completely and in which the spray head 22 and regions of the spray head holder 40 are received in the mounted state of the protective cap 1'. A positively locking connection is preferably generated between the end 36 of the cap neck 4 and the spray head 22, with the result that the end 36 of the cap neck 4' is also held or fixed firmly on the sprinkler nozzle 10 so as to rotate with it.

Like the protective cap 1, the protective cap 1' has a lateral introduction and discharge slot 20'. A wall region 42 of the cap main body 2' and the cap neck 4', which wall region 42 is arranged so as to lie opposite the introduction and discharge slot 20', is of elastically deformable configuration. The wall region 42 is preferably configured from a material which has elastic properties. As a result of the recess 38 at the end 34 and the opening 44 at the opposite end 45 of the protective cap 1', the wall region 42 has a greater deformability in comparison with the remaining wall regions of the protective cap 1. The regions on both sides of the wall region 42 in each case form protective cap limbs 46, 46', the orientations of which change on both sides of an introduction and discharge plane 48 while the protective cap 1' is brought into contact or out of contact with a sprinkler nozzle 10.

In contrast to the protective cap 1, the protective cap 1' has two second handles 24' in the form of actuating flanks 50, 50' which extend on both sides along the lateral introduction and discharge slot 20' and assume an angle $\alpha$ of approximately 90° with respect to one another in the embodiment which is shown. Via the actuating flanks 50, 50' which are shown in FIGS. 3 and 4, the protective cap limbs 46, 46' are moved apart in an assisting manner while the cap 1 is brought out of contact with the sprinkler nozzle 10.

FIGS. 5 and 6 show a sprinkler nozzle 10 with a protective cap 1 which is mounted on the sprinkler nozzle. For attaching and removing the protective cap 1, the bracket 26 is gripped on its handle section 28. The protective cap 1 can be pushed with its cap main body 2 and its cap neck 4 via the lateral introduction and discharge slot 20 onto the nozzle main body 8, the spray head 22 and the spray head holder 40. In one embodiment which is shown, the guide means 30 on the inner contour of the cap main body 2 engages into a groove-like guide part 52 which is provided on the nozzle main body 8. In this way, the protective cap 1 is guided in the radial direction during the attaching or removal. Moreover, locking of the protective cap 1 against movement in the direction of the longitudinal axis of the sprinkler nozzle 1 takes place by means of the guide means 30 and the guide part 52. In addition, the cap neck 4 has a wall region with a substantially elliptical outer form, which wall region forms a right-angled shoulder in the transition to the cap main body 2. In this way, the protective cap limbs 46, 46' are given a relatively rigid configuration on both sides of the wall region 42. The cap necks 4, 4' of the above-described embodiments of the protective caps 1, 1' end in each case at a spacing from the spraying disk 16 of the spray head 22. The spraying disk 16 is not protected by way of the protective caps 1, 1'. On the nozzle main body 8, the sprinkler nozzle 10 has a threaded section 54 for screwing into and out of an outlet opening of a pipeline. Furthermore, a nozzle outlet 56 is arranged on the nozzle main body 8, which nozzle outlet 56 can be closed by way of a closure element 58 in that embodiment of the sprinkler nozzle 10 which is shown. Other embodiments of sprinkler nozzles (not shown) have only one nozzle outlet 56 without a closure element.

Figure 7:
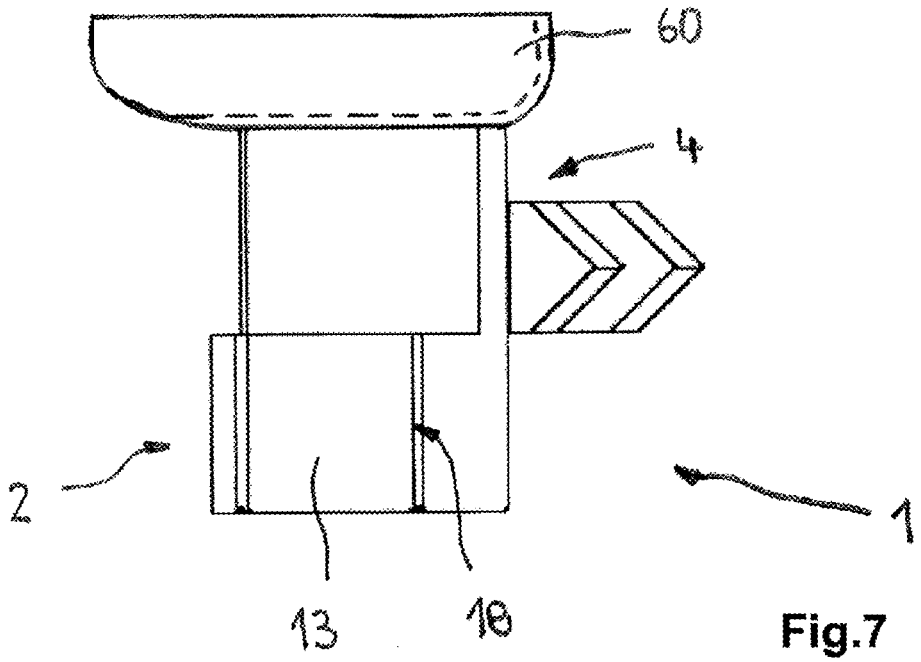
FIG.7 shows a view of a further embodiment of a protective cap with a cap shield.
Figure 8:
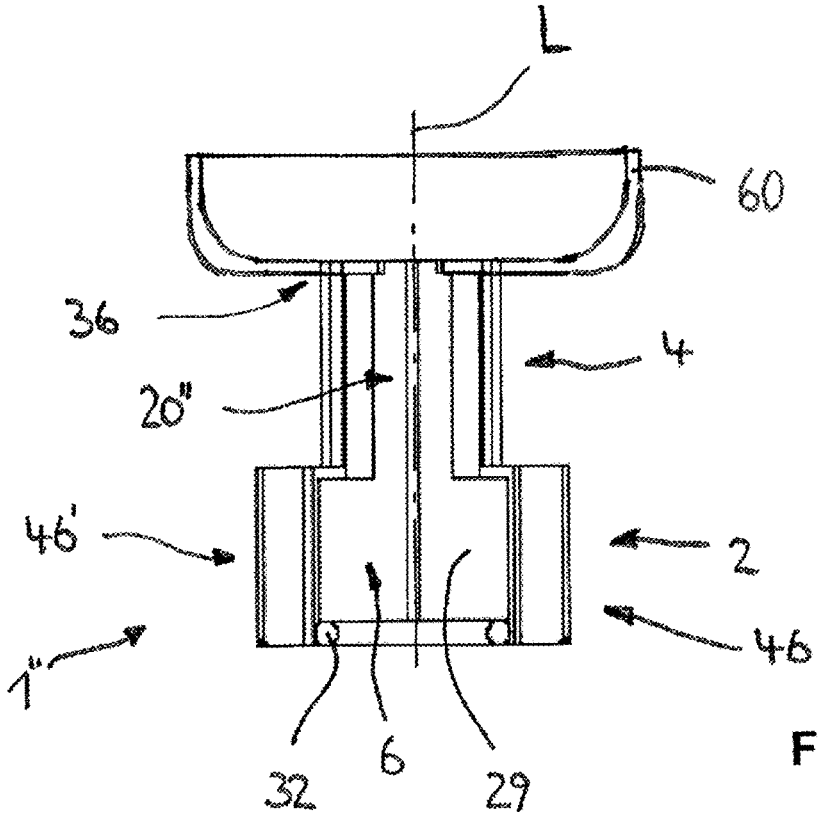
FIG.8 shows a side view of the protective cap in accordance with FIG. 7.

FIGS. 7 and 8 show one embodiment of a protective cap 1" which has a cap shield 60 in addition to the cap main body 2 and to the cap neck 4. The cap shield 60 is arranged at the spray head-side end 36 of the cap neck 4 and is set up to enclose the spraying disk 16 of the sprinkler nozzle 10 in sections. As the present FIGS. 7 and 8 illustrate, the cap shield 60 is of open configuration at its end which faces away from the cap neck 4. Furthermore, the cap shield 60 has a common introduction and discharge slot 20" together with the cap main body 2 and the cap neck 4, which common introduction and discharge slot 20" extends over the entire height of the protective cap 1". The slot width of the introduction and discharge slot 20" changes over the height of the protective cap 1" on account of the different dimensions of the nozzle main body 8, the spray head holder 40, the spray head 22 and the spraying disk 16. The section of the lateral introduction and discharge slot 20" is adapted to the outer contour of the spraying disk 16 in the region of the cap shield 60. With regard to the configuration of the cap main body 2 and the cap neck 4, the protective cap 1" is virtually identical to that embodiment of the protective cap 1 which is described in FIGS. 1 and 2. Identical components are therefore denoted by the same designations.

List of Utilized Reference Numbers

1, 1', 1" Protective cap
2, 2' Cap main body
4, 4' Cap neck
6 Force transmission section
8 Nozzle main body
10 Sprinkler nozzle
12, 12' Action surface
13 Outer contour
14 Triggering element
16 Spraying disk
18 Tool attachment
"L" Longitudinal axis
20, 20', 20" Introduction and discharge slot
22 Spray head
24, 24' Handle
26 Bracket
28, 28' Handle part
29 Inner contour
30 Guide means
32 Projection
34 Terminating face
36 End
38 Recess
40 Spray head holder
42 Wall region

44 Opening
44 End
46, 46' Protective cap limb
48 Introduction and discharge plane
50, 50' Actuating flank
52 Guide part
52 Threaded section
56 Nozzle outlet
58 Closure element
60 Cap shield

The invention claimed is:

1. A protective cap for an extinguishing nozzle, which has a nozzle main body with a nozzle outlet, the protective cap comprising: a cap main body, and a cap neck which is arranged on the cap main body, the cap main body and the cap neck having a lateral introduction and discharge slot, the cap main body having an inner contour including a force transmission section for bearing against the nozzle main body of the extinguishing nozzle in a force-transmitting, and in a positively locking manner, and the cap neck being set up to mechanically shield the nozzle outlet of the extinguishing nozzle, the cap main body having an outer contour with one or more action surfaces that attach to a tool without direct contact between the tool and the extinguishing nozzle, wherein the one or more action surfaces on the outer contour is arranged at a same horizontal plane as the force transmission section on the inner contour of the cap main body.

2. The protective cap as claimed in claim 1, wherein the extinguishing nozzle comprises a sprinkler nozzle including a spray head, and wherein the cap neck is dimensioned in such a way that, in a mounted state on the sprinkler nozzle, the spray head is enclosed partially or completely.

3. The protective cap as claimed in claim 2, wherein the sprinkler nozzle further includes a spraying disk which is arranged on the spray head, wherein the cap neck is dimensioned in such a way that, in the mounted state, it is arranged spaced apart from the spraying disk on the spray head of the sprinkler nozzle.

4. The protective cap as claimed in claim 3, wherein a cap shield for enclosing the spraying disk of the sprinkler nozzle is arranged on the cap neck.

5. The protective cap as claimed in claim 4, wherein the cap shield has a lateral introduction and discharge slot for the spraying disk of the sprinkler nozzle, which lateral introduction and discharge slot is adapted to an outer contour of the spraying disk which can be guided through the slot.

6. The protective cap as claimed in claim 2, wherein, at a spray head-side end of the cap neck, the cap neck has a terminating face with a recess for at least one section of the spray head.

7. The protective cap as claimed in claim 6, wherein the recess in the terminating face has a shape which is adapted to a shape of the spray head and is set up to fix an end which faces the spray head on the spray head.

8. The protective cap as claimed in claim 1, the extinguishing nozzle having a trigger element, and the cap neck being set up to shield the trigger element mechanically.

9. The protective cap as claimed in claim 1, the extinguishing nozzle having a closure element which is arranged on the nozzle outlet, the cap neck and/or the cap main body being set up to shield the closure element mechanically in a mounted state.

10. The protective cap as claimed in claim 1, wherein the lateral introduction and discharge slot extends substantially parallel to a longitudinal axis of the protective cap.

11. The protective cap as claimed in claim 10, wherein the introduction and discharge slot extends over an entire height of the protective cap, and a slot width of the introduction and discharge slot changes over the entire height of the protective cap.

12. The protective cap as claimed in claim 10, wherein at least one wall region of the cap main body and the cap neck, is arranged so as to lie opposite the introduction and discharge slot, and is elastically deformable.

13. The protective cap as claimed in claim 1, wherein the one or more action surfaces comprise a polygonal tool attachment which is configured with a predefined flats width.

14. The protective cap as claimed in claim 1, wherein, on an inner contour of the cap main body which faces the nozzle main body, the cap main body has a guide which is set up to guide the protective cap in a radial direction with respect to a longitudinal axis of the extinguishing nozzle along a guide part of corresponding configuration on the nozzle main body while being brought into contact or out of contact.

15. The protective cap as claimed in claim 14, wherein the guide is configured as a projection which protrudes on the inner contour of the cap main body.

16. The protective cap as claimed in claim 1, wherein the cap main body and the cap neck are configured in one piece.

17. The protective cap as claimed in claim 1, further comprising one or more handles which can be actuated by hand in order to bring the cap main body into contact or out of contact with the nozzle main body.

18. The protective cap as claimed in claim 17, further comprising a first handle which is arranged on the cap neck and is configured as a bracket.

19. The protective cap as claimed in claim 17, further comprising two second handles which are configured as two actuating flanks which extend on both sides along the lateral introduction and discharge slot and are oriented with respect to one another at an angular range $\alpha$ of from approximately 60° to 120° .

20. A kit, comprising the sprinkler nozzle with the nozzle main body with the nozzle outlet, and the protective cap as claimed in claim 4 which is mounted on the sprinkler nozzle.

21. A method for mounting an extinguishing nozzle, on a pipeline of a nozzle pipe system of a fire extinguishing system, comprising the steps:

bringing a protective cap into contact with at least one nozzle main body of an extinguishing nozzle by wav of a lateral introduction and discharge slot, or providing an extinguishing nozzle which is equipped with a protective cap by way of a lateral introduction and discharge slot:

fastening the extinguishing nozzle which is equipped with the protective cap to an outlet opening of a pipeline of a nozzle pipe network using a tool, the tool for fastening the extinguishing nozzle being attached to an outer contour of the protective cap by way of one or more action surfaces without direct contact between the tool and the extinguishing nozzle, the one or more action surfaces being on a same plane as a horizontal plane of a force transmission section on an inner contour of the protective cap, and removing the protective cap from the extinguishing nozzle which is mounted on the pipeline, by the protective cap being pulled off in a radial direction with respect to a longitudinal axis of the extinguishing nozzle.

22. A method for dismantling an extinguishing nozzle, from a pipeline of a nozzle pipe system of a fire extinguishing system, comprising the steps:

bringing a protective cap into contact with at least one nozzle main body of an extinguishing nozzle by way of a lateral introduction and discharge slot:

releasing the extinguishing nozzle which is equipped with the protective cap at an outlet opening of a pipeline of a nozzle pipe network using a tool, the tool for releasing the extinguishing nozzle being attached on an outer contour of the protective cap by way of one or more action surfaces without direct contact between the tool and the extinguishing nozzle, the one or more action surfaces being on a same plane as a horizontal plane of a force transmission section on an inner contour of the protective cap; and removing the extinguishing nozzle from the pipeline and leaving the protective cap on the dismantled extinguishing nozzle.

* * * * *